US009213314B2

(12) United States Patent
Calabrese et al.

(10) Patent No.: US 9,213,314 B2
(45) Date of Patent: Dec. 15, 2015

(54) TWO-DIRECTIONAL DATE CORRECTOR MECHANISM FOR A DATE MECHANISM, DATE MECHANISM, TIMEPIECE

(75) Inventors: Vincent Calabrese, Lausanne (CH); Sebastien Graf, Le Mont-sur-Lausanne (CH)

(73) Assignee: Blancpain S.A., Le Brassus (CH)

( * ) Notice: Subject to any disclaimer, the term of this patent is extended or adjusted under 35 U.S.C. 154(b) by 79 days.

(21) Appl. No.: 13/811,169

(22) PCT Filed: Jun. 7, 2011

(86) PCT No.: PCT/EP2011/059348

§ 371 (c)(1), (2), (4) Date: Mar. 27, 2013

(87) PCT Pub. No.: WO2012/010369

PCT Pub. Date: Jan. 26, 2012

(65) Prior Publication Data

US 2013/0201801 A1 Aug. 8, 2013

(30) Foreign Application Priority Data

Jul. 21, 2010 (EP) ..... 10170330

(51) Int. Cl.
*G04B 19/24* (2006.01)
*G04B 3/00* (2006.01)
(Continued)

(52) U.S. Cl.
CPC ..... *G04B 19/24* (2013.01); *G04B 19/25* (2013.01); *G04B 19/253* (2013.01);
(Continued)

(58) Field of Classification Search
CPC ..... G04B 19/24; G04B 19/253; G04B 19/25306; G04B 19/25313; G04B 19/25326; G04B 19/25333; G04B 19/2534; G04B 19/25346; G04B 19/25373; G04B 19/25386; G04B 27/00
USPC ..... 368/28, 31–38, 185, 190
See application file for complete search history.

(56) References Cited

U.S. PATENT DOCUMENTS 3,775,966 A * 12/1973 Matsuura ..... 368/32
3,890,778 A * 6/1975 Aeschmann ..... 368/74
(Continued)

FOREIGN PATENT DOCUMENTS

| | | |
|---|---|---|
| CH | 376 059 | 5/1963 |
| EP | 0 871 093 | 10/1998 |
| EP | 0871093 A1 * | 10/1998 |
| EP | 1 953 611 | 8/2008 |

OTHER PUBLICATIONS

International Search Report Issued Aug. 24, 2011 in PCT/EP11/59348 Filed Jun. 7, 2011.

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

A two-directional date corrector mechanism controlled by a pull-out piece for a date mechanism. The mechanism includes a 24 hour wheel, a date updating finger pivoting integrally therewith, a date driving star-wheel, and a corrector star-wheel meshing therewith and located between the date driving star-wheel and the finger and configured to be uncouplable from the finger under action of an uncoupling mechanism controlled by the pull-out piece, the uncoupling mechanism having a coupling position where the corrector star-wheel meshes with the finger, and an uncoupling position where it is released from the finger to allow the date to be corrected. A date mechanism can include such a date corrector mechanism and a timepiece can include such a date corrector mechanism.

21 Claims, 8 Drawing Sheets

(51) Int. Cl.

| | |
|---|---|
| ***G04B 27/00*** | (2006.01) |
| ***G04B 19/20*** | (2006.01) |
| ***G04B 19/25*** | (2006.01) |
| *G04B 19/253* | (2006.01) |

(52) U.S. Cl.

CPC ..... *G04B 19/2534* (2013.01); *G04B 19/25306* (2013.01); *G04B 19/25313* (2013.01); *G04B 19/25326* (2013.01); *G04B 19/25333* (2013.01); *G04B 27/00* (2013.01); *G04B 3/00* (2013.01); *G04B 19/25346* (2013.01); *G04B 19/25373* (2013.01); *G04B 19/25386* (2013.01)

(56) References Cited

U.S. PATENT DOCUMENTS

| | | | | |
|---|---|---|---|---|
| 3,892,067 | A * | 7/1975 | Meylan-Piguet | 368/36 |
| 5,504,721 | A * | 4/1996 | Calabrese | 368/185 |
| 2001/0046187 | A1 * | 11/2001 | Graemiger | 368/190 |
| 2004/0095850 | A1 * | 5/2004 | Schmiedchen et al. | 368/190 |
| 2007/0109916 | A1 * | 5/2007 | Bron | 368/35 |
| 2008/0106979 | A1 * | 5/2008 | Bron et al. | 368/34 |
| 2008/0181060 | A1 * | 7/2008 | Mahler et al. | 368/192 |
| 2010/0027381 | A1 | 2/2010 | Mahler et al. | |
| 2012/0020192 | A1 | 1/2012 | Calabrese | |

* cited by examiner

TWO-DIRECTIONAL DATE CORRECTOR MECHANISM FOR A DATE MECHANISM, DATE MECHANISM, TIMEPIECE

CROSS REFERENCE TO RELATED APPLICATIONS

This is a National Phase Application in the United States of International Patent Application PCT/EP2011/059348 filed Jun. 7, 2011, which claims priority on European Patent Application No. 10170330.4 of Jul. 21, 2010. The entire disclosures of the above patent applications are hereby incorporated by reference.

FIELD OF THE INVENTION

The invention concerns a two-directional date corrector mechanism controlled by an actuating pull-out piece pivoting about a pivot axis, for a timepiece date mechanism. Said date mechanism comprises a twenty-four hour wheel driven by the movement of said timepiece, a date updating finger mounted to pivot integrally with said twenty-four hour wheel about a pivot axis, and a date driving star-wheel. Said corrector mechanism comprises a corrector star-wheel pivotally moveable about a pivot axis and located between said finger and said date driving star-wheel.

The invention further concerns a date mechanism comprising a date driving star-wheel and a twenty-four hour wheel comprising a date updating finger, provided with a date corrector mechanism of this type.

The invention further concerns a timepiece comprising a date mechanism including a date driving star-wheel and a twenty-four hour wheel comprising a date updating finger, provided with a date corrector mechanism of this type.

BACKGROUND OF THE INVENTION

The invention concerns the field of horology, and more specifically the field of timepieces including date display mechanisms.

Date mechanisms are complex mechanisms.

The date has to be manually corrected for months of less than thirty-one days, in the case of timepieces with a simple calendar mechanism. This correction is generally either performed by rotating the winding stem into a rapid date set position, or by actuating a pusher dedicated to this use.

Updating the date is not always easy, in particular when the user wishes to change the date close to midnight.

Moreover, most known mechanisms do not allow the date to be changed backwards.

U.S. Pat. No. 212,882 in the name of Baillot, presented, in 1879, a date corrector mechanism using a click cooperating, under the action of a pusher, with the toothing of a 31 day wheel to move said wheel forward.

There is known from EP Patent No. 1 115,041 in the name of Chopard Manufacture SA, a rapid manual date corrector mechanism for a movement comprising a winding stem with three axial positions with a sliding pinion and a date star-wheel. This mechanism comprises a rocking corrector lever comprising, at one end thereof, a beak cooperating with the toothing of the date star-wheel, and at the other end thereof, a finger returned by a spring against a cam having at least one lifting piece. This cam is carried by a corrector wheel driven via a kinematic connection by the sliding pinion, when the winding stem is in an intermediate, axial, date correction position. The lifting pieces of the cam are pointed, thus when the winding stem is not in the date setting position, the return spring of the finger on the cam causes said finger to return between two lifting pieces of the cam, so that the beak of the lever is no longer in contact with the date star-wheel. This mechanism allows the date to be advanced by rotating the winding stem in any direction, but it does not allow the date to be moved backwards.

EP Patent No. 1,660,952 in the name of Vaucher Manufacture Fleurier SA discloses a manual date corrector for a simple calendar mechanism and an automatic date corrector for a perpetual calendar. This corrector comprises a means of programming the rectification of the date display according to the number of days of the current month entered by the user or by an automatic mechanism, and a means of retrieving the rectification on the last actual day of the month concerned. This programming means includes a coupling wheel set formed of two coaxial toothed discs which can be driven in opposite directions, one by the thirty-one wheel, and the other by the control means which sets the number of days of the month, so that at the end of the current month, the display means is automatically corrected. These two discs are coupled by a spring and by a click system allowing one disc to rotate independently of the other. The clicks also enable the second disc, which is driven by the control means, firstly to drive the other disc when it is rotating in the first direction, and secondly, not to drive said other disc when it is rotating in the other direction when said second disc then merely winds the spring. In addition to these discs, the programming means includes a finger secured to the thirty-one wheel, a lever which pivots on the second disc and is actuated by the finger on the last day of the current month, and which then actuates another independent lever of the coupling wheel set. This other lever locks the second disc and releases it when actuated, so that, under the action of the spring, the first disc rapidly moves to rectify the date display. This complex device performs correction both manually and automatically, but it too is unable to move the date backwards instead of forwards.

Likewise, EP Patent No. 1 538 494 in the name of Watch-U-License AG is known, which discloses a rapid date setting device comprising a pull-out piece, which is driven by the winding stem and pivots a lever carrying a lever pinion which, in an intermediate position of the winding stem, meshes with a wheel coupled to a date corrector wheel set provided with fingers capable of acting on a date indicator crown. This device requires an intermediate pinion set, and is one-directional.

EP Patent No. 0 230 878 in the name of Complications SA proposes a date corrector comprising a stem driving, via a gear train, a corrector star-wheel which meshes directly with a date star-wheel. This simple system cannot, however, be used permanently since, close to midnight, the date star-wheel is cooperating with an elastic finger of the twenty-four wheel, and any manual intervention is then damaging for the movement. Further, this mechanism can only move the date forwards and not backwards.

A more complex date corrector mechanism for a perpetual calendar is presented by EP Patent No. 1488 290 in the name of Manufacture Roger Dubuis SA. This mechanism is indexed on the position of an annual cam, detected by a sensor, and arranged for automatic operation, but not for manual correction.

However, these known mechanisms all use the kinematic chain of the winding mechanism and the sliding pinion, and the operation of updating the date occurs day by day, is quite fiddly and causes wear of the winding and time-setting mechanism. Above all, although some mechanisms allow the winding stem to rotate in both directions to advance the date, they can only change the date in a single higher date direction, which of course means passing through the change from 31 to 1 in order to return to a lower date than that previously displayed.

EP Patent No. 1 953 611 in the name of Compagnie des Montres Longines, Francillon SA, discloses a two-directional correction mechanism for a display device such as a date mechanism. This mechanism provides a reliable and efficient solution to the problem of correcting the date backwards. Two racks tend to act in opposite ways on the date display wheel. The first rack is controlled by a first lever which cooperates with a snail cam integral with a date wheel, which is in turn driven each day by a finger integral with the twenty-four hour wheel. The second rack is controlled by a second lever, which cooperates with a peripheral cam driven by the winding stem, and this peripheral cam is arranged to move the first lever away from the snail cam. Thus the date wheel can pivot in both directions. However, this improved mechanism includes numerous components, making it relatively expensive, and the space required, particularly as regards the peripheral cam, makes it difficult to adapt to all movements.

EP Application No. 0 871 093 A1 in the name of ORIS is also known, which discloses a manual date indicator corrector mechanism in the form of a toothed ring. A first or second device may be coupled one at a time to the date indicator, as a result of uncoupling means. The first device is used only for correcting the date indicator, and the second device is for correcting the hour and minute hands and the date indicator. The second device is a wheel set comprising a first star-wheel able to mesh with the toothed ring, and a second star-wheel able to mesh with a finger carried by an intermediate wheel. The intermediate wheel meshes with the hour wheel. The uncoupling means is a plate, which carries the wheel set and is returned by the spring, pivoting on an arbour carrying the intermediate wheel. The wheel set is engaged when the first star-wheel meshes with the ring. The wheel set is disengaged when the first device is actuated. The first star-wheel no longer meshes with the ring, whose teeth push those of the first star-wheel out of their trajectory against the return force of the spring. The positions of engagement and disengagement are defined by the position of a pin, secured to the plate, relative to an oblong hole of the plate, which is integral in particular with the spring. This mechanism fits the description of the preamble of the claim of this patent application.

SUMMARY OF THE INVENTION

The invention proposes to provide a solution to the problem of correcting the date at any time, and in both directions, with the smallest possible number of components and a small space requirement.

The invention therefore concerns a two-directional date corrector mechanism controlled by an actuating pull-out piece pivotally mounted about a pivot axis, for a timepiece date mechanism. Said date mechanism comprises a twenty-four hour wheel driven by the movement of said timepiece, a finger for updating the date mechanism mounted to pivot integrally with said twenty-four hour wheel about a pivot axis, and a date driving star-wheel. Said corrector mechanism comprises a corrector star-wheel pivotally moveable about a pivot axis and located between said finger and said date driving star-wheel. The invention is characterized in that said corrector star-wheel is arranged to mesh with said date driving star-wheel, and in that said corrector star-wheel is arranged to be uncouplable from said finger under the action of an uncoupling mechanism controlled by said pull-out piece, said uncoupling mechanism having at least two positions including at least a first coupling position in which said corrector star-wheel is arranged to mesh with said finger, and at least a second uncoupling position in which said corrector star-wheel is released from said finger to enable the date to be corrected by the pivoting of said corrector star-wheel causing said date star-wheel to pivot.

According to a feature of the invention, said uncoupling mechanism has three positions, including a first said coupling position and a third said coupling position, which are on either side of a second said uncoupling position.

According to a feature of the invention, said uncoupling mechanism includes a means of relative movement of said pivot axis of said corrector star-wheel relative to said pivot axis of said finger, by the movement of at least one of said axes.

According to a feature of the invention, said means of relative movement includes a means of transforming a one-directional motion, applied to said actuating pull-out piece, into two pivoting movements in opposite directions of a first lever pivotally mounted relative to a pivot axis, said first lever including a first means of abutment arranged to directly or indirectly control the relative movement of the pivot axis of said corrector star-wheel relative to the pivot axis of said finger.

According to a feature of the invention, said first means of abutment is formed by a first bearing surface of said first lever arranged to abut with a hub integral with said finger, or with a hub integral with said corrector star-wheel, to move said finger away from said corrector star-wheel or respectively to move said corrector star-wheel away from said finger.

According to a feature of the invention, said first bearing surface is a first oblong hole arranged to receive and guide said hub integral with said finger, or said hub integral with said corrector star-wheel.

According to another feature of the invention, said first means of abutment is arranged to cooperate with a complementary means of abutment comprised in a second lever which is arranged, on a second bearing surface comprised therein, to abut with said hub integral with said finger, or with said hub integral with said corrector star-wheel, so as to move said finger away from said corrector star-wheel or respectively to move said corrector star-wheel away from said finger.

According to a feature of the invention, said second bearing surface is a second oblong hole arranged to receive and guide said hub integral with said finger, or said hub integral with said corrector star-wheel.

According to a feature of the invention, said means of transforming a one-directional movement, applied to said actuating pull-out piece, into two opposite pivoting motions of a first lever pivotally mounted relative to a pivot axis, includes at least, on a first edge of said first lever, one cam arranged to cooperate with a point of abutment of said pull-out piece and extending substantially radially relative to said pivot axis, said cam comprising, on the same side of a radial line derived from said pivot axis and passing through a turn-back point, on either side of said turn-back point, a first path and a second path arranged to generate pivoting motions in opposite directions of said first lever during a centripetal, respectively centrifugal travel, of said point of abutment of said pull-out piece from said first path towards said second path, respectively from said second path towards said first path, passing through said turn-back point at which the reversal of the direction of pivoting of said first lever occurs.

According to another feature of the invention, said first lever is driven by a drive means or by an elastic return means.

According to another feature of the invention, said elastic return means is arranged to return said cam into abutment on said point of abutment of said pull-out piece.

According to another feature of the invention, said point of abutment of said pull-out piece is formed by a pin describing a circular rotational motion about said pivot axis of said pull-out piece.

According to another feature of the invention, said date corrector mechanism includes a plate comprising an oblong hole arranged to receive and guide said hub integral with said finger, or said hub integral with said corrector star-wheel.

According to the embodiments of the invention, the relative mobility between the corrector star-wheel and the finger is obtained, either by the mobility of the corrector star-wheel pivot axis, when the finger pivot axis is locked, or by the mobility of the finger pivot axis, when the corrector star-wheel pivot axis is locked, or by the mobility of the corrector star-wheel pivot axis and the mobility of the finger pivot axis.

The invention further concerns a date mechanism comprising a date driving star-wheel and a twenty-four hour wheel comprising a date updating finger and provided with a two-directional date corrector mechanism of this type.

The invention further concerns a timepiece comprising a date mechanism including a date driving star-wheel and a twenty-four hour wheel comprising a date updating finger and provided with a two-directional date corrector mechanism.

BRIEF DESCRIPTION OF THE DRAWINGS

Other features and advantages of the invention will appear upon reading the following description, with reference to the annexed drawings, in which.

DETAILED DESCRIPTION OF PREFERRED EMBODIMENTS

Figure 1:
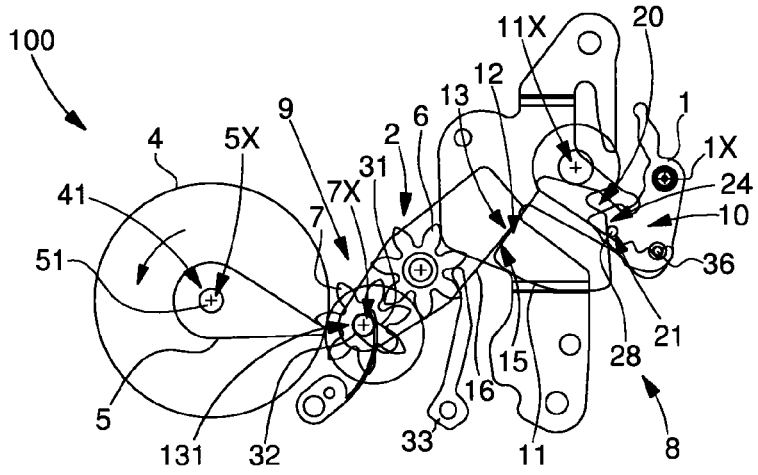
FIG. 1 shows a schematic, plan view of a first embodiment of the invention, in a first position of a pull-out piece which is a first coupled position of a corrector star-wheel with a finger integral with a twenty-four hour wheel.

The invention concerns the field of horology, and more specifically the field of timepieces including date display mechanisms. The invention thus proposes to provide a solution to the problem of correcting the date at any time and in both directions.

The invention therefore concerns a two-directional date corrector mechanism 100 controlled by an actuating pull-out piece 1, for a date mechanism 2 of a timepiece 3. This actuating pull-out piece 1, controlled by actuating a stem 60, is in particular a pull-out piece with a crown, more specifically the pull-out piece of the time-setting and/or winding crown of the timepiece 3. Pull-out piece 1 is pivotally moveable about a pivot axis 1X.

According to the invention, this date mechanism 2 includes, on the one hand, a twenty-four hour wheel 4 driven by the movement of timepiece 3, and on the other hand, a finger 5 for updating the date. This finger 5 is mounted to pivot integrally with twenty-four hour wheel 4 about a pivot axis 5X. Date mechanism 2 further includes a date driving star-wheel 6.

Corrector mechanism 100 comprises a corrector star-wheel 7 which is pivotally moveable about a pivot axis 7X, and which is located between finger 5 and date driving star-wheel 6.

According to the invention, this corrector star-wheel 7 is arranged to mesh with date driving star-wheel 6, and it may be permanently meshed therewith. The daily motion of finger 5 for updating the date can only be transmitted to date driving star-wheel 6 via this corrector star-wheel 7.

In a particular manner according to the invention, corrector star-wheel 7 is arranged to be able to be uncoupled from finger 5 under the action of an uncoupling mechanism 8.

This uncoupling mechanism 8 is controlled by actuating pull-out piece 1 and it has at least two positions, including at least a first coupling position, where corrector star-wheel 7 is arranged to mesh with finger 5 or at least to interfere with the trajectory thereof, since said finger 5 only makes one revolution in twenty-four hours, and at least a second uncoupling position, where corrector star-wheel 7 is released from said finger 5 to allow the date to be corrected by the pivoting thereof causing the date driving star-wheel 6 to pivot.

Preferably, as seen in FIGS. 1 to 12, uncoupling mechanism 8 has three positions including a first coupling position and a third coupling position, on either side of a second said uncoupling position.

This uncoupling mechanism 8 includes a means of relative movement 9 of pivot axis 7X of corrector star-wheel 7 relative to the pivot axis 5X of finger 5, by the movement of at least one of said axes 7X and/or 5X.

In the preferred embodiments seen in FIGS. 1 to 18 which will be explained in detail below, this relative movement means 9 includes a means 10 of transforming a one-directional movement, applied to said actuating pull-out piece 1, into two opposite pivoting movements of a first lever 11 pivotally mounted relative to a pivot axis 11X. This first lever 11 comprises a first means of abutment 12 arranged to directly or indirectly control the relative movement of the pivot axis 7X or corrector star-wheel 7 relative to pivot axis 5X of finger 5. Advantageously, the movement of actuating pull-out piece 1 is linear.

Figure 7:
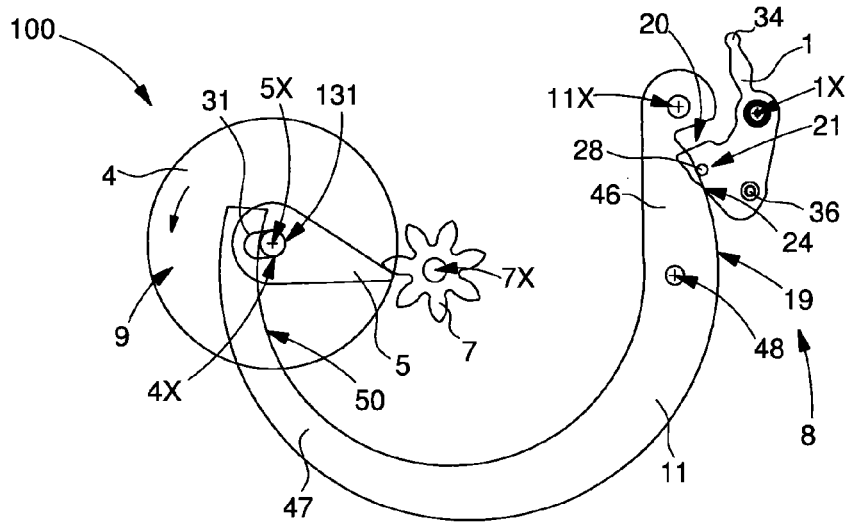
FIG. 7 shows a schematic plan view of a third embodiment of the invention, in a first position of the pull-out piece which is a first coupled position of the corrector star-wheel with the finger integral with the twenty-four hour wheel.
Figure 8:
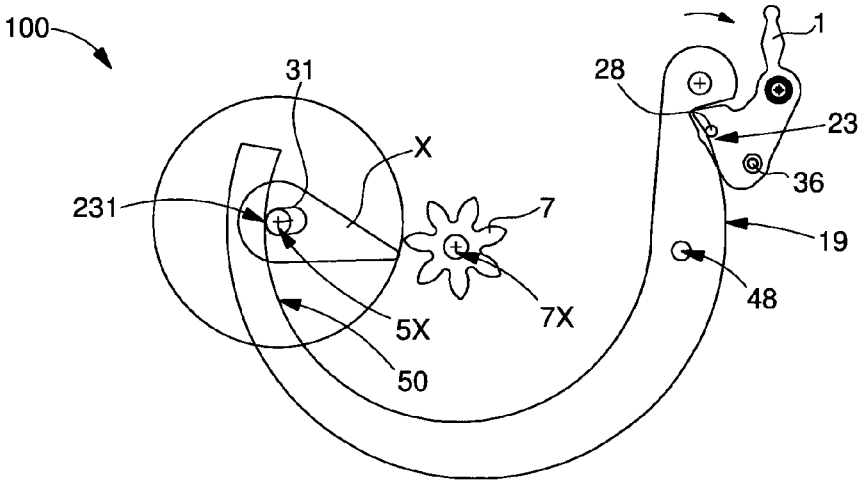
FIG. 8 shows, in a similar manner to FIG. 7, the same mechanism in a second position of the pull-out piece which is the date correction position, with the corrector star-wheel in an uncoupled position relative to the finger integral with the twenty-four hour wheel.
Figure 9:
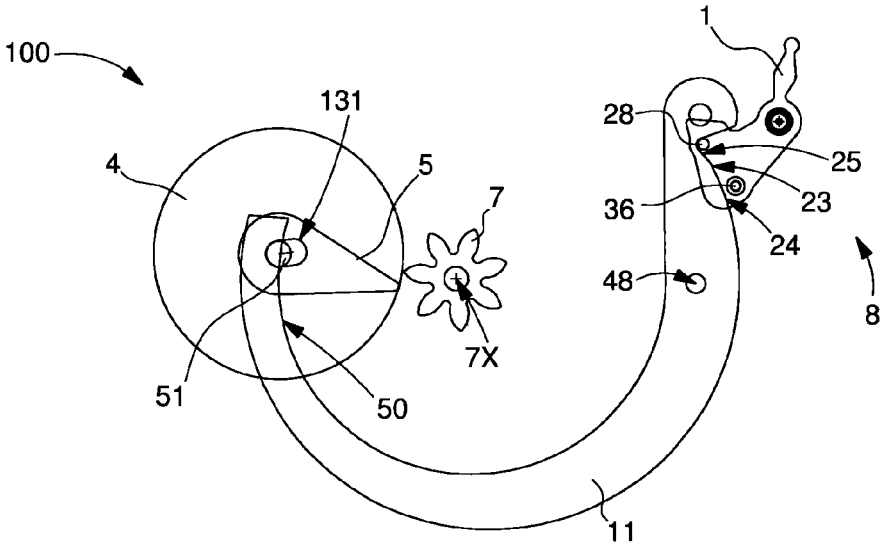
FIG. 9 shows, in a similar manner to FIG. 7, the same mechanism in a third position of the pull-out piece which is another coupled position of the corrector star-wheel with the finger integral with the twenty-four hour wheel.

In a third advantageous embodiment seen in FIGS. 7 to 9, the first means of abutment 12 is formed by a first bearing surface 13 of first lever 11, which is arranged to abut with a hub 51 integral with finger 5 to move finger 5 away from corrector star-wheel 7, or, in another variant embodiment, to abut with a hub 71 integral with corrector star-wheel 7 to move corrector star-wheel 7 away from finger 5.

Figure 10:
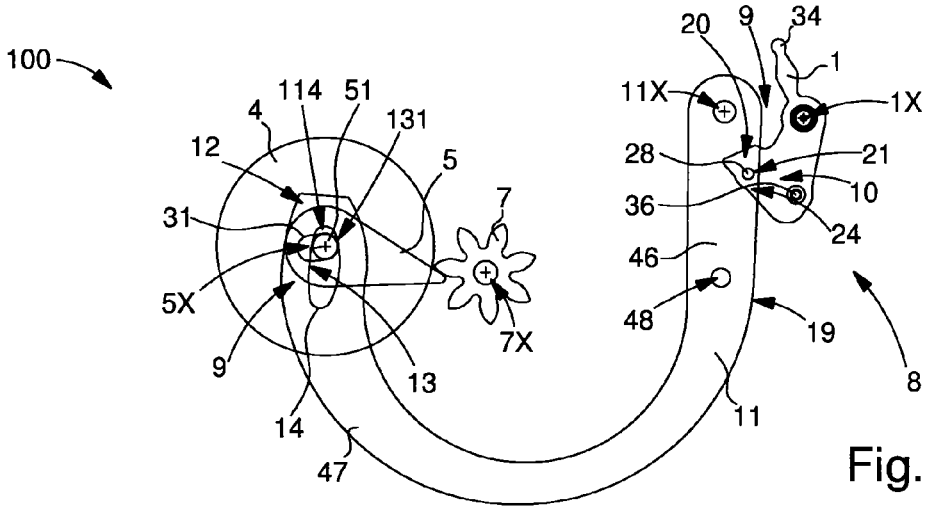
FIG. 10 shows a schematic, plan view of a fourth preferred embodiment of the invention, in a first position of the pull-out piece which is the first coupled position of the corrector star-wheel with the finger integral with the twenty-four hour wheel.
Figure 11:
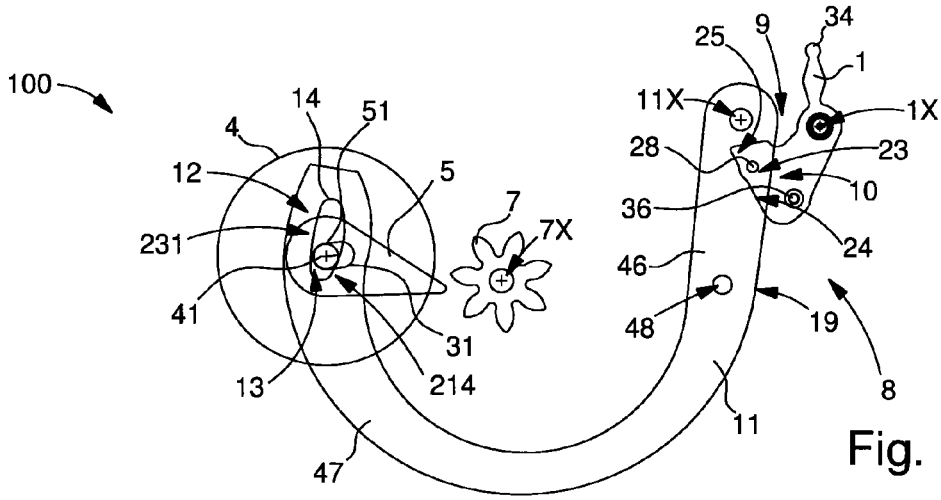
FIG. 11 shows, in a similar manner to FIG. 10, the same mechanism in a second position of the pull-out piece which is the date correction position, with the corrector star-wheel in an uncoupled position relative to the finger integral with the twenty-four hour wheel.
Figure 12:
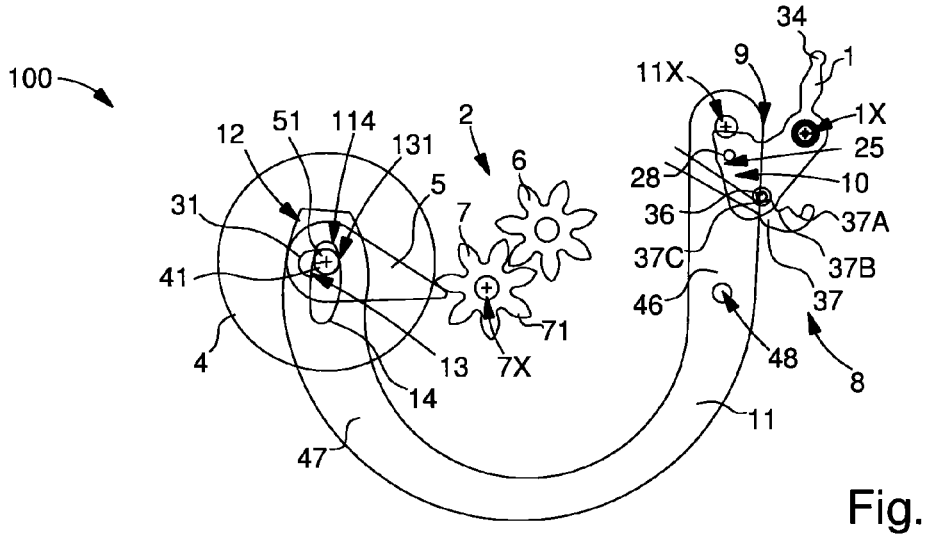
FIG. 12 shows, in a similar manner to FIG. 10, the same mechanism in a third position of the pull-out piece which is another coupled position of the corrector star-wheel with the finger integral with the twenty-four hour wheel.

In an advantageous embodiment, as in the example of the fourth embodiment illustrated by FIGS. 10 to 12, the first bearing surface 13 is a first oblong hole 14 arranged to receive and guide hub 51 integral with finger 5, or, in other variant embodiments, arranged to receive and guide hub 71 integral with corrector star-wheel 7.

Figure 2:
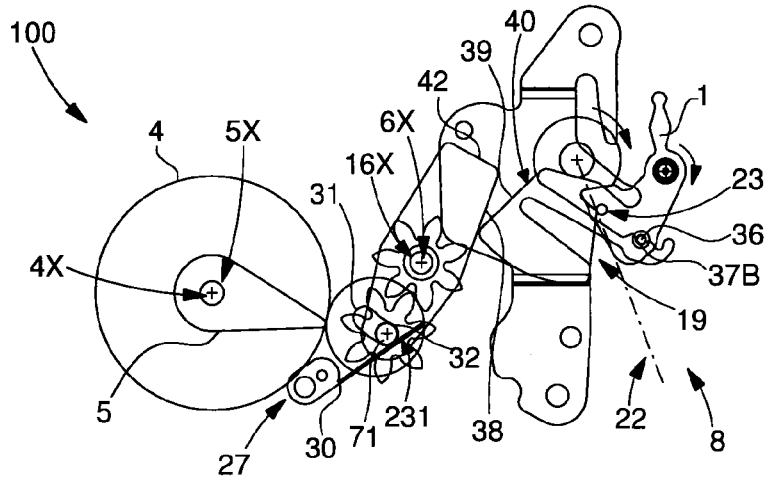
FIG. 2 shows, in a similar manner to FIG. 1, the same mechanism in a second position of the pull-out piece which is a date correction position, with the corrector star-wheel in an uncoupled position relative to the finger integral with the twenty-four hour wheel.
Figure 3:
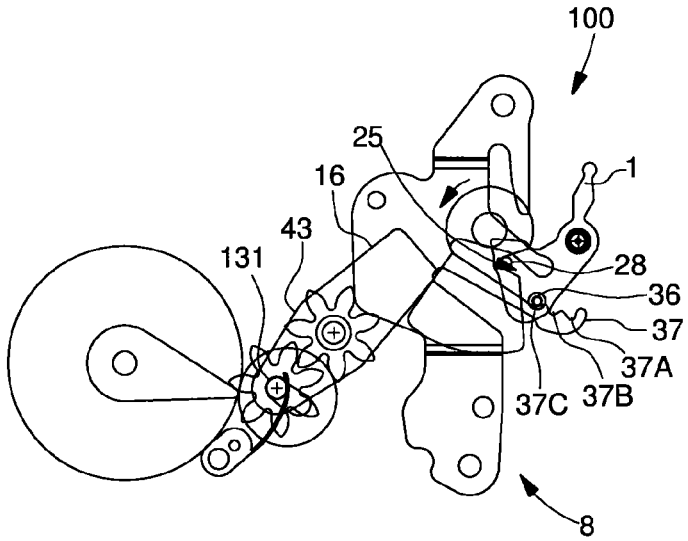
FIG. 3 shows, in a similar manner to FIG. 1, the same mechanism in a third position of the pull-out piece which is another coupled position of the corrector star-wheel with the finger integral with the twenty-four hour wheel.
Figure 4:
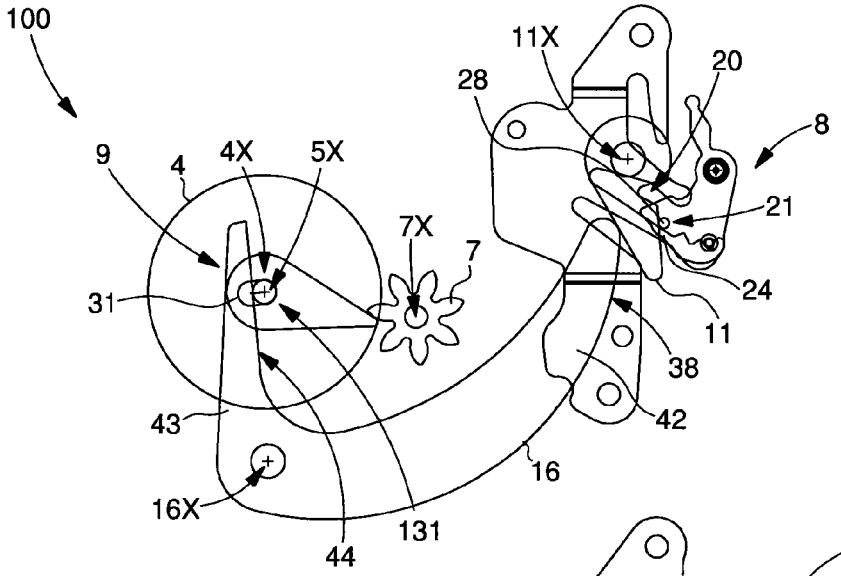
FIG. 4 shows a schematic, plan view of a second embodiment of the invention, in a first position of the pull-out piece which is a first coupled position of the corrector star-wheel with the finger integral with the twenty-four hour wheel.
Figure 5:
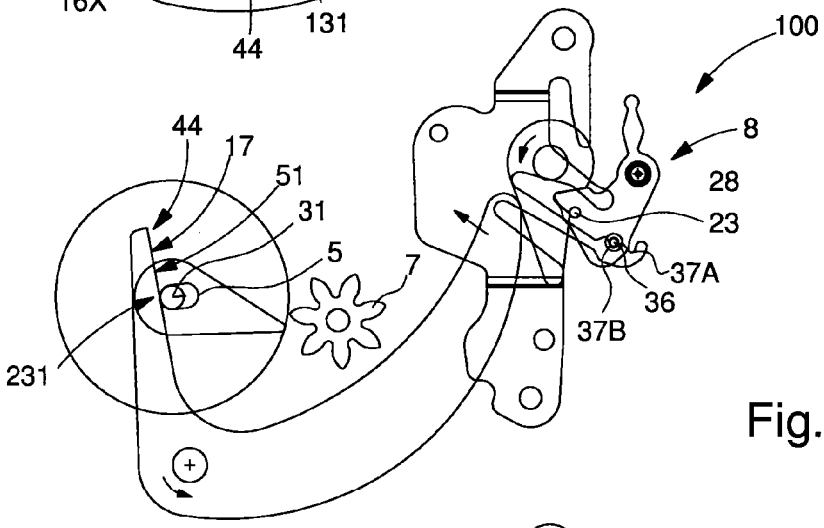
FIG. 5 shows, in a similar manner to FIG. 4, the same mechanism in a second position of the pull-out piece which is the date correction position, with the corrector star-wheel in an uncoupled position relative to the finger integral with the twenty-four hour wheel.
Figure 6:
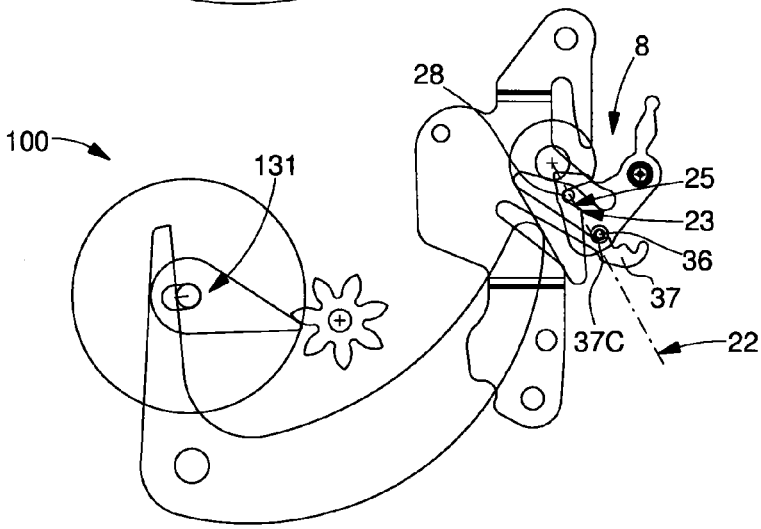
FIG. 6 shows, in a similar manner to FIG. 4, the same mechanism in a third position of the pull-out piece which is another coupled position of the corrector star-wheel with the finger integral with the twenty-four hour wheel.

In a particular embodiment, the first means of abutment 12 is arranged to cooperate with a complementary means of abutment 15 comprised in a second lever 16. This second lever 16 is arranged to abut, on a second bearing surface 17 comprised therein, with hub 51 integral with finger 5, as seen in FIGS. 4 to 6, to move finger 5 away from corrector star-wheel 7. Or second lever 16 is arranged to abut with hub 71 integral with corrector star-wheel 7, as seen in FIGS. 1 to 3, to move corrector star-wheel 7 away from finger 5.

In a particular embodiment, the second bearing surface 17 is a second oblong hole arranged in the second lever 16 to receive and guide hub 51 integral with finger 5, or to receive and guide hub 71 integral with corrector star-wheel 7.

The means 10 of transforming a one-directional movement, applied to actuating pull-out piece 1, into two opposite pivoting movements of a first lever 11 pivotally mounted relative to a pivot axis 11X may be made in various manners. Preferably, this transforming means 10 includes at least one cam 20 on a first edge 19 of first lever 11. This cam 20 is arranged to cooperate with a point of abutment 21 of actuating pull-out piece 1 and it extends substantially radially relative to pivot axis 11X of first lever 11.

Cam 20 includes, on either side of a turn-back point 23, and preferably on the same side of a radial line 22 derived from said pivot axis 11X and passing through said turn-back point 23, a first path 24 and a second path 25. These paths are arranged to generate pivoting movements in opposite directions of first lever 11 during a centripetal, respectively centrifugal, travel of the point of abutment of actuating pull-out piece 1 from first path 24 to second path 25, respectively from second path 25 to first path 24, passing through said turn-back point 23, at which the reversal of direction of pivoting of first lever 11 occurs.

First lever 11 is preferably arranged to be directly or indirectly driven by a drive means 26 or by an elastic return means 27, such as springs or similar. Preferably, this elastic return means 27 is arranged to return cam 20 into abutment on point of abutment 21 of actuating pull-out piece 1.

In a particularly economical embodiment as seen in FIGS. 1 to 12, the point of abutment 21 of actuating pull-out piece 1 is formed by a first pin 28 describing a circular rotational movement about pivot axis 1X of actuating pull-out piece 1.

Advantageously, actuating pull-out piece 1 is formed by the winding and time-setting pull-out piece of timepiece 3.

Preferably, a plate 29, particularly an additional plate, acts as a support for the whole of mechanism 100. This plate 29 includes, in certain embodiments, as seen in FIGS. 1 to 9, an oblong hole 31 arranged to receive and guide hub 51 integral with hub 5 or hub 41 of twenty-four hour wheel 4, whose finger 5 pivots integrally therewith, or hub 71 integral with corrector star-wheel 7.

Elastic return means 27 is advantageously formed by a spring or a jumper-spring 30, fixed to said plate 29, and which has a tendency to push, directly or more generally indirectly, corrector star-wheel 7 towards finger 5 integral with twenty-four hour wheel 4 to place corrector star-wheel 7 in abutment on said finger 5. This elastic return means 27 may be, in particular, formed of several springs, or similar, independent of each other but all contributing to the return of corrector star-wheel 7 and finger 5 towards each other.

According to the embodiments of the invention, the relative mobility between corrector star-wheel 7 and finger 5 may be obtained by the mobility of pivot axis 7X of corrector star-wheel 7, when the pivot axis 5X of finger 5 is fixed, or by the mobility of pivot axis 5X of finger 5, when pivot axis 7X of corrector star-wheel 7 is fixed, or by the mobility of pivot axis 7X of corrector star-wheel 7 and by the mobility of pivot axis 5X of finger 5.

FIGS. 1 to 18 illustrate five embodiments according to this principle.

A first embodiment is illustrated by FIGS. 1 to 3, and illustrates the case of mobility of pivot axis 7X of corrector star-wheel 7, with pivot axis 5X of finger 5 being fixed.

Uncoupling mechanism 8 includes, downstream of pull-out piece 1 actuated by the user, a first lever 11, which is pivotally moveable about a pivot axis 11X and a second lever 16, which is pivotally moveable about a pivot axis 16X and acts directly on corrector star-wheel 7.

Pivot axis 7X of corrector star-wheel 7 moves, via a pin mounted on the hub 71 thereof, or preferably via said hub 71 itself, in an oblong hole 31 which is arranged in plate 29 and defines end positions 131 and 231 between which corrector star-wheel 7 can be moved.

The mobility of corrector star-wheel 7 in oblong hole 31 is provided via the second lever 16, which comprises a bore 32 cooperating with hub 71 of corrector star-wheel 7 or with a pin integral with hub 71. This oblong hole 31 extends preferably substantially perpendicularly to the direction which joins axis 6X of date driving star-wheel 6 to axis 7X of corrector star-wheel 7, and substantially radially relative to pivot axis 4X of twenty-four hour wheel 4, which tends to move hub 71 of corrector star-wheel 7 substantially radially relative to finger 5. Preferably, pivot axis 16X of second lever 16 is close, and preferably common to a pivot axis 6X about which date driving star-wheel 6 pivots, which is preferably retained by a jumper spring 33.

The source of motion for controlling the uncoupling is provided by actuating pull piece 1. This pull-out piece 1 is actuated in the example of the Figures by a pull-out piece arm 34, and is pivotally moveable about a pull-out piece axis 1X, to control a pivoting movement of first lever 11. Pull-out piece 1 comprises two points of abutment, preferably made in the form of pins:

- a first point of abutment 21, made in the example of the Figures in the form of a first pin 28, which is arranged to abut on a first edge 19 of the first lever 11, either on a first path 24, which is preferably substantially straight or slightly curved, or on a second path 25 forming a groove, or on a turn-back point 23 located between said first path 24 and said second path 25;
- a second pull-out pin 36, which is arranged to cooperate with one of notches 37A, 37B, 37C comprised in the edge of a pull-out piece spring arm 37 fixed to plate 29.

Pull-out piece 1, and therefore first lever 11, occupies three positions illustrated in succession in FIGS. 1 to 3.

A first and a third coupling position of first lever 11 have a normal position, i.e. coupled, and corrector star-wheel 7 is abutting on finger 5. These two positions are on either side of a second position, called the uncoupling position, of the first lever 11 in which corrector star-wheel 7 is released from finger 5, thereby allowing the date to be corrected, by a wheel integral with corrector star-wheel 7 and manually operated by a correction gear train connected to stem 60.

FIG. 1 illustrates the first position of the pull-out piece, where a crown connected to pull-out piece 1 is pushed in. Pull-out piece 1 is held in position by the cooperation of its second pin 36 with a first notch 37A of the pull-out piece spring arm 37. The first pin 28 thereof abuts on the first edge 19 of first lever 11. This first lever 11 is pressed against first pin 28, since it is subject to a torsion torque exerted by spring 30: the torsion torque is applied by spring 30 onto corrector star-wheel 7 and has a tendency to drive bore 32 of second lever 16 in the clockwise direction relative to pivot axis 16X, as seen in FIG. 1.

Consequently, second lever 16 tends to pivot clockwise, and thus to press a first bearing surface 38 comprised therein, on the opposite side to bore 16C relative to axis 16X, against a complementary bearing surface 39 comprised in a second edge 40 of first lever 11, opposite the first edge 19 thereof. Second lever 16 thus has a tendency to rotate first lever 11 in the anticlockwise direction and thus to abut on first pin 28. This first pin 28 therefore limits the angular travel of first lever 11, and consequently corrector star-wheel 7 remains in abutment on finger 5. Preferably, first edge 19 and second edge 40 are substantially straight, or slightly curved, and move away from each other in an increasing radius relative to pivot axis 11X of first lever 11.

Pivot axis 16X of second lever 16 is located substantially between the pivot axis 11X of first lever 11 and pivot axis 7X of corrector star-wheel 7. The second lever 16 includes, on either side of its pivot axis 16X, two arms: a first arm 42 carrying the first bearing surface 38, and the other second arm 43 carrying bore 32, and these two arms 42 and 43 are on the same side relative to pivot axis 5X of finger 5. Hub 71 of corrector star-wheel 7 abuts on a first end 131 of oblong hole 31 in the plate.

FIG. 2 illustrates the second uncoupling position. Pull-out piece arm 34 is in an intermediate date correction position. The traction of pull-out piece 1 causes the second pin 36 to pass onto a second notch 37B of pull-out piece spring arm 37. The torque exerted by the latter in this position is greater than that exerted, indirectly, by spring 30 on first lever 11, and the first pin 28 remains in abutment on one end of first path 24, closer to pivot axis 11X of first lever 11, on the turn-back point 23 of cam 20 formed by the first edge 19 of first lever 11.

The traction of pull-out piece 1 tends to pivot first lever 11 clockwise, to push back the first bearing surface 38 of second lever 16 and rotate said lever anti-clockwise. Consequently, hub 71 of corrector star-wheel 7 is driven by bore 32 of second lever 16 towards a second end 231 of oblong hole 31 in plate 29, through a sufficient angle to move out of reach of finger 5, and is thus released from finger 5. Thus, corrector star-wheel 7 can be operated, both forwards and backwards, for the correction of the date display.

FIG. 3 illustrates the third position of the pull-out piece, with a crown connected to pull-out piece 1 in a position of maximum traction. First lever 11 comprises, after first path 24 and turn-back point 23, and on the side of pivot axis 11X, a second path 25, in the form of a groove which is set back from the first path 24, i.e. recessed on the side of the complementary bearing surface 39 of first lever 11 at second edge 40 thereof. Pull-out piece 1 is held by the abutment of the second pin 36 in a third notch 37C of pull-out piece spring arm 37.

The traction of pull-out piece 1 brings first pin 28 into the groove of second path 25 and consequently allows a rotation of the first lever 11, again in the anti-clockwise direction. The second lever 16 pivots in the clockwise direction, and returns corrector star-wheel 7 into its new angular position after the date has been set, in cooperation with finger 5, since hub 71 of corrector star-wheel 7 abuts on a first end 131 of oblong hole 31 in the plate.

When the pull-out piece of the timepiece time-setting mechanism is used, it is therefore possible to set the time in this pulled-out position of pull-out piece 1 and the associated crown. The timepiece is then returned to its usual position by pushing the crown into the first position of pull-out piece 1.

In short, in this first embodiment, the pivot axis 5X of finger 5 is fixed, whereas the pivot axis 7X of corrector star-wheel 7 is moveable.

The other embodiments illustrate the case where pivot axis 5X of finger 5 is moveable, whereas pivot axis 7X of corrector star-wheel 7 is fixed. The arrangement of pull-out piece 1 is the same in these three particular embodiments. However, pivot axis 7X of corrector star-wheel 7 is fixed relative to plate 29. As regards the mobility of finger 5, two possibilities exist: either finger 5 is moveable, particularly radially, relative to twenty-four hour wheel 4, or it is the assembly formed by twenty-four hour wheel 4 and by finger 5 can be moved. This second alternative is illustrated by the following embodiments, but does not in any way limit the invention.

The second embodiment is illustrated in FIGS. 4 to 6.

Pull-out piece 1 still cooperates with a first lever 11. However, the arrangement of the latter is different from that of the first embodiment, and preferably, first path 24 and second path 25 are substantially straight, and move closer to each other in an increasing radius relative to pivot axis 11X of first lever 11.

Unlike the first embodiment, the pivot axis 7X of corrector star-wheel 7 is located substantially between pivot axis 11X of first lever 11 and pivot axis 16X of second lever 16. The two arms, respectively first arm 42 and second arm 43, of second lever 16 are on both sides of pivot axis 5X of finger 5.

Second lever 16 is held in contact against first lever 11 via a spring, which is not shown in the Figures.

In this second embodiment, hub 41 with pivot axis 4X of twenty-four hour wheel 4 is moveable in an oblong hole 31 in plate 29, which enables it to move while remaining in contact with the gear of the centre wheel of the movement which powers it. This oblong hole 31 preferably extends substantially in the direction which joins axis 4X of twenty-four hour wheel 4 to axis 7X of corrector star-wheel 7, which tends to move hub 41, and thus finger 5, substantially radially to corrector star-wheel 7. A return means, such as a spring, not shown in the Figures, tends to move said hub 41 away from corrector star-wheel 7, by pushing back or pulling said hub 41 to the end 231 of oblong hole 31 the furthest from corrector star-wheel 7.

Second lever 16 comprises, on the first arm 42 thereof, a first bearing surface 38 which cooperates with first lever 11 in a similar manner to the first embodiment. Lever 16 also includes, on the second arm 43 thereof, a second bearing surface 44, which pivots angularly in the same direction as the first bearing surface 38, said two surfaces being located on the same side of pivot axis 16X. This second bearing surface 44 is opposite a hub 41 comprised in twenty-four hour wheel 4, and is held at a distance therefrom during normal operation, to avoid unnecessarily braking the movement. The twenty-four hour wheel 4 is still meshed with the centre wheel of the movement, regardless of the position of the pivot axis 4X thereof, or of a hub 41 comprised therein, relative to the oblong hole 31 in plate 29.

FIG. 4 illustrates the first pushed-in position of pull-out piece 1, which is held in position by the cooperation of the second pin 36 thereof with a first notch 37A of the pull-out piece spring arm 37. The first pin 28 thereof abuts on the first path 24 of first lever 11. This first lever 11 is pressed against first pin 28, since it is subject to a torsion torque exerted by the spring which presses second lever 16 against said lever 11: the torsion torque is applied by said spring to second lever 16 and tends to press the second bearing surface 44 comprised in second arm 43 of second lever 16, onto hub 41 of twenty-four hour wheel 4, to push said hub 41 to a first end 131 of the oblong hole 31 on the side of the corrector star-wheel 7 and therefore tends to push finger 5 in cooperation with corrector star-wheel 7. Finger 5 cannot therefore avoid driving corrector star-wheel 7 via second lever 16 which is held in contact against first lever 11 via the spring.

FIG. 5 illustrates the second uncoupling position. Pull-out piece arm 34 is in an intermediate date correction position. The traction of pull-out piece 1 causes the second pin 36 to pass onto a second notch 37B of pull-out piece spring arm 37. The torque exerted by said spring arm is greater that that exerted, indirectly, by the spring which pushes second lever 16 towards first lever 11, and first pin 28 is abutting on turn-back point 23. The traction of pull-out piece 1 therefore tends to cause first lever 11 to pivot, to push back the first bearing surface 38 of the second lever 16 and to rotate the latter in the anti-clockwise direction.

Consequently, the second bearing surface 44, comprised in second arm 43 of second lever 16 pivots and allows hub 41 of twenty-four hour wheel 4, which tends to be moved away from corrector star-wheel 7 by a return spring which is not shown in the Figures, to move in oblong hole 31 on the opposite side to corrector star-wheel 7, along a sufficient travel to escape therefrom, to reach the second end of hole 31, in the position shown in FIG. 5. Thus, corrector star-wheel 7 can be operated both forwards and backwards, for the correction of the date display.

The advantage is that the twenty-four hour wheel 4 returns to the same place after correction without losing its bearings.

FIG. 6 illustrates the third position of the pull-out piece, in the maximum traction position of a crown connected to pull-out piece 1, which is held by the abutment of second pin 36 in a third notch 37C of pull-out piece spring arm 37. The traction of pull-out piece 1 brings the first pin 28 into the groove of the second path 25. Consequently, this movement allows a rotation of first lever 11 again in the anti-clockwise direction. Second lever 16 pivots clockwise and returns the second bearing surface 44, comprised in second arm 43 of second lever 16, onto hub 41 of twenty-four hour wheel 4, and into abutment on the first end 131 of hole 31, and thus tends to push finger 5 in cooperation with corrector star-wheel 7. Finger 5 thus cannot avoid being driven by corrector star-wheel 7.

The third embodiment is illustrated in FIGS. 7 to 9. In this embodiment, the combination of the first lever 11 and second lever 16 is replaced by a single first lever 11, which includes, on the same side of its pivot axis 11X preferably located at one end thereof, a first arm 46 and a second arm 47. First lever 11 is held in contact against pull-out piece 1 by a return means which tends to pivot said lever anti-clockwise. This return means is applied to a driving point 48 of first lever 11. It may be formed of a spring, not shown in the Figures, or by an intermediate lever which in turn comprises a spring, as seen in another fifth embodiment in FIGS. 13 to 15, or another element.

Pivot axis 4X of twenty-four hour wheel 4 is, as in the second embodiment, moveable in an oblong hole 31 in plate 29, which allows it to move while remaining in contact with the gear of the centre wheel of the movement which powers it. This oblong hole 31 preferably extends substantially in the direction which joins axis 4X of twenty-four hour wheel 4 to axis 7X of corrector star-wheel 7, which tends to move hub 41, and thus finger 5, substantially radially to corrector star-wheel 7. The movements of pull-out piece 1 and the cooperation of second pin 36, in the various positions, with notches 37A, 37B, 37C, of pull-out piece spring arm 37, are similar to the other embodiments.

FIG. 7 illustrates the first position of the pull-out piece, where pull-out piece 1 is pushed in. Pull-out piece 1 is held in position by the cooperation of the second pin 36 thereof with a first notch 37A of the pull-out piece spring arm 37, which is not shown in this Figure. The first pin 28 is abutting on the first edge 19, which is located on the first arm 46, on first path 24. This position of first lever 11 allows a second bearing surface 50 comprised in second arm 47 to rest on hub 41 of twenty-four hour wheel 4, to hold it at a first end 131 of oblong hole 31 on the side of the corrector star-wheel 7 and thus to mesh finger 5 with corrector star-wheel 7.

FIG. 8 illustrates the second uncoupling position. Pull-out piece arm 34 is in an intermediate date correction position. The traction of pull-out piece 1 causes second pin 36 to pass onto a second notch 37B of the pull-out piece spring arm 37, not shown in this Figure. The torque exerted by the latter in this position is greater than that exerted, indirectly, by the return means which pushes back the first lever 11 towards pull-out piece 1, and the first pin 28 remains in abutment on turn-back point 23. The traction of pull-out piece 1 therefore tends to pivot first lever 11, to push back the second bearing surface 50 of second arm 47, moving it away from corrector star-wheel 7. Consequently, hub 41 of twenty-four hour wheel 4, which tends to be moved away from corrector star-wheel 7 by a return spring (not shown in the Figures), can move in oblong hole 31 on the opposite side to corrector star-wheel 7, along a sufficient travel to escape therefrom, to reach the position at the second end 231 of oblong hole 31 shown in FIG. 8. Thus, corrector star-wheel 7 can be operated both forwards and backwards, for the correction of the date display.

FIG. 9 illustrates the third position of the pull-out piece, which is the position of maximum traction of a crown connected to pull-out piece 1, which is held by the abutment of the second pin 36 in a third notch 37C of the pull-out piece spring arm 37. The traction of pull-out piece 1 brings the first pin 28 into the groove of the second path 25. Consequently, this movement allows a rotation of first lever 11 in the opposite direction, which returns the second bearing surface 50 of second arm 47 into abutment on hub 41 of twenty-four hour wheel 4, pushing it back to first end 131 of the oblong hole 31 closest to corrector star-wheel 7, and thus tends to push finger 5 in cooperation with corrector star-wheel 7. Finger 5 thus cannot avoid being driven by corrector star-wheel 7.

The fourth embodiment is illustrated in FIGS. 10 to 12. As in the third embodiment, the combination of the first lever 11 and second lever 16 is replaced by a single first lever 11, which includes, on the same side of its pivot axis 11X preferably located at one end thereof, a first arm 46 and a second arm 47. First lever 11 is held in contact against pull-out piece 1 by a return means which tends to pivot said lever anticlockwise. This return means is applied to a point of driving 48 of first lever 11. It may be formed of a spring (not shown in the Figures), or by an intermediate lever which in turn comprises a spring, or other element.

The pivot axis 4X of twenty-four hour wheel 4 is moveable both in an oblong hole 31 in plate 29, which allows its to move while remaining in contact with the gear of the centre wheel of the movement, which powers it, in a similar manner to that of the second and third embodiments described above, and in a first oblong hole 14, which is arranged in the second arm 47 of first lever 11. This first oblong hole 14 extends in an oblique direction relative to the direction of oblong hole 31 in plate 29. Any substantially tangential movement of second arm 47 relative to corrector star-wheel 7 then drives hub 41 substantially radially relative to corrector star-wheel 7. The movements of pull-out piece 1 and the cooperation of second pin 36, in the various positions, with notches 37A, 37B, 37C, of pull-out piece spring arm 37, are similar to the other embodiments.

FIG. 10 illustrates the first position of the pull-out piece, where pull-out piece 1 is pushed in. Pull-out piece 1 is held in position by the cooperation of the second pin 36 thereof with a first notch 37A of the pull-out piece spring arm 37, which is not shown in this Figure. The first pin 28 is abutting on the first edge 19, which is located on the first arm 46, on first path 24. This position of first lever 11 tends to pivot said lever, and to pull the second arm 47, by forcing hub 41 of twenty-four hour wheel 4 to occupy a first holding position at a first end 114 of the first oblong hole 14 and at a first end 131 of the oblong hole 31, in a position where finger 5 can mesh with corrector star-wheel 7.

FIG. 11 illustrates the second uncoupling position. Pull-out piece arm 34 is in an intermediate date correction position. The traction of pull-out piece 1 causes second pin 36 to pass onto a second notch 37B of the pull-out piece spring arm 37, not shown in this Figure. The torque exerted by the latter in this position is greater than that exerted, indirectly, by the return means which pushes the first lever 11 back towards pull-out piece 1, and the first pin 28 remains in abutment at the turn-back point 23. This position of first lever 11 tends to pivot said lever, and to push the second arm 47, by forcing hub 41 to occupy a second holding position at a second end 214 of the first oblong hole 14 and at a second end 231 of oblong hole 31, in a position where finger 5 is disengaged from corrector star-wheel 7.

FIG. 11 illustrates the third position of the pull-out piece, which is the position of maximum traction of a crown connected to pull-out piece 1, which is held by the abutment of the second pin 36 in a third notch 37C of the pull-out piece spring arm 37. The traction of pull-out piece 1 brings the first pin 28 into the groove of the second path 25. Consequently, this movement allows a rotation of first lever 11 in the opposite direction, which returns the second arm 47 into traction, forcing hub 41 of twenty-four hour wheel 4 to occupy a first holding position at a first end 114 of the first oblong hole 14 and at a first end 131 of the oblong hole 31, in a position where finger 5 can mesh with corrector star-wheel 7.

The invention further concerns a date mechanism 2 comprising a date driving star-wheel 6 and a twenty-four hour wheel 4 comprising a date updating finger 5 and provided with a two-directional date corrector mechanism 100 of this type.

The invention further concerns a timepiece 3 comprising a date mechanism 2 including a date driving star-wheel 6 and a twenty-four hour wheel 4 comprising a date updating finger 5, and provided with a two-directional date corrector mechanism 100 of this type.

Figure 13:
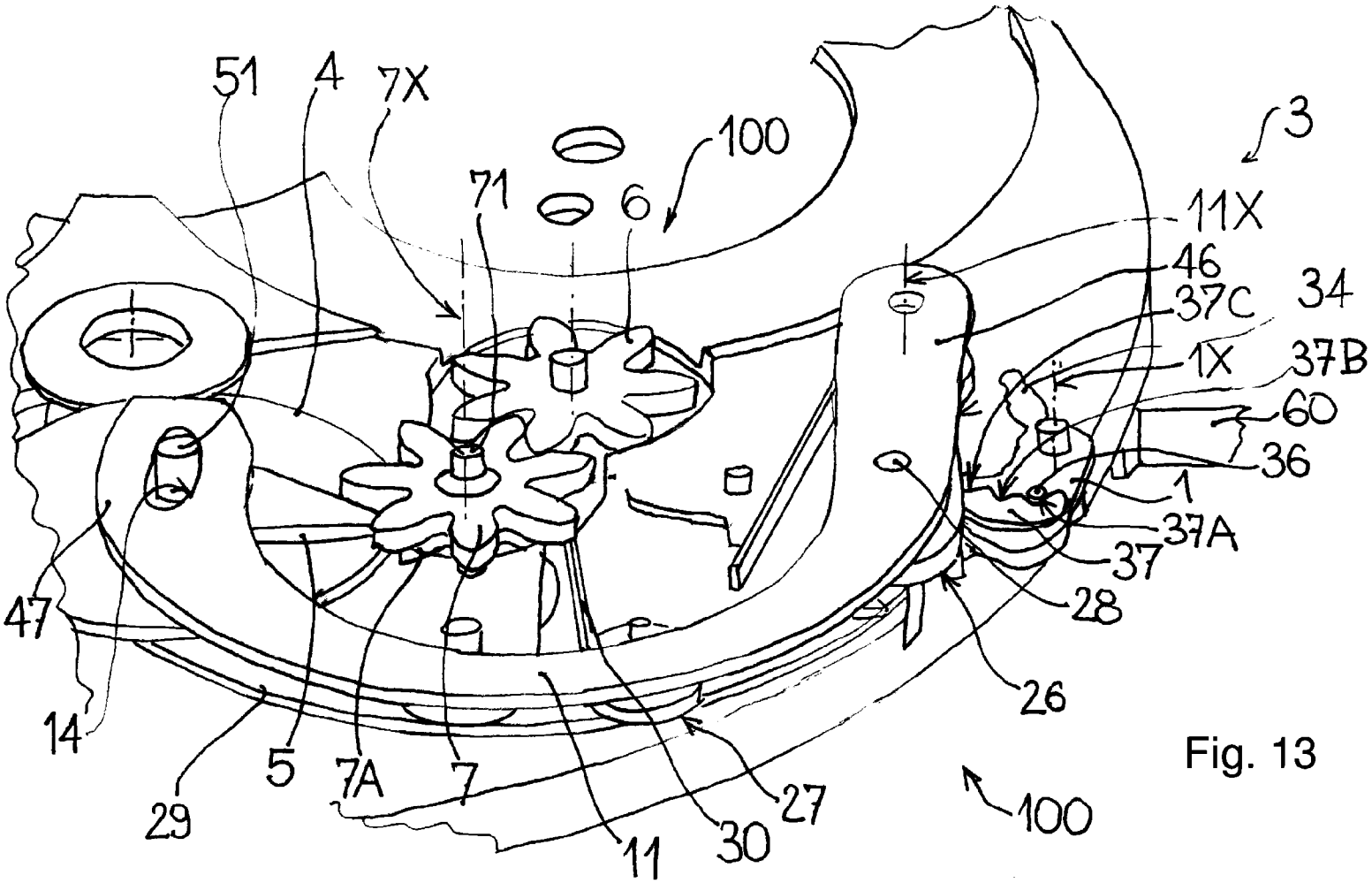
FIG. 13 shows a schematic, partial, perspective, top view of a timepiece comprising a date corrector mechanism, in a fifth embodiment derived from the fourth embodiment.
Figure 14:
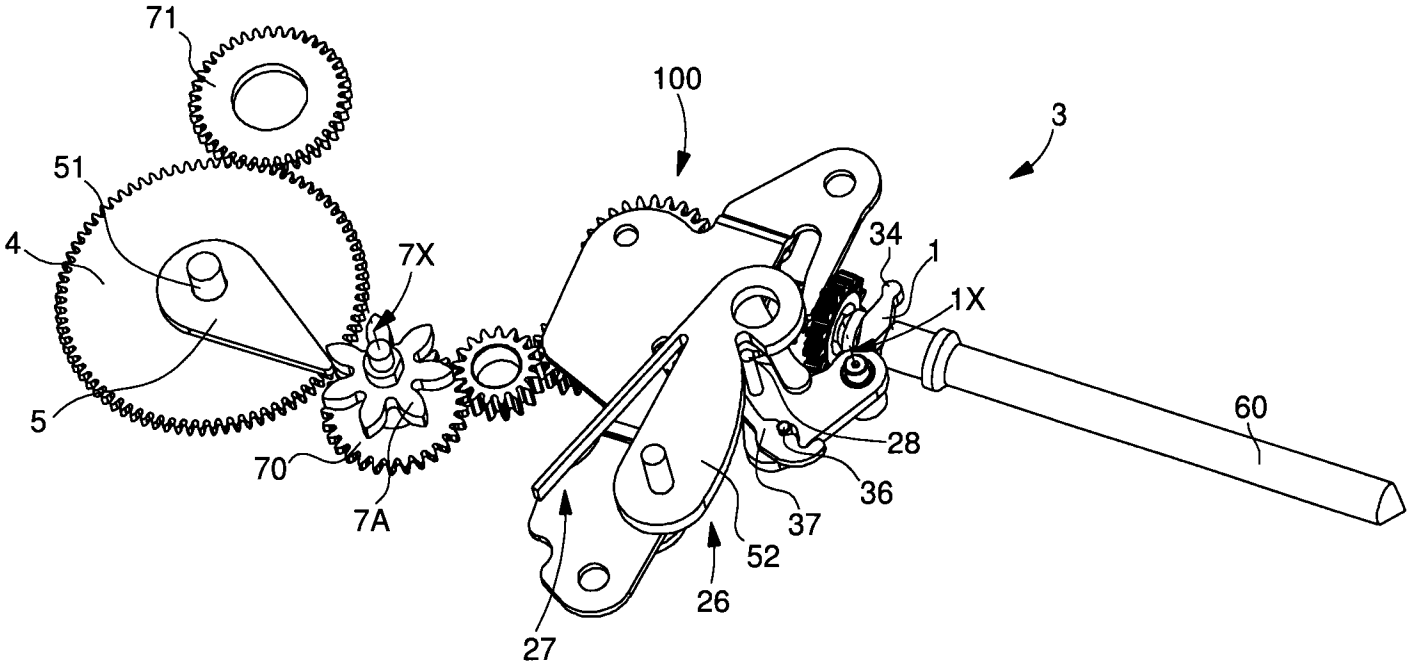
FIG. 14 shows a schematic, partial, perspective, top view of the mechanism of FIG. 13, where the main lever abutting on the finger is omitted.
Figure 15:
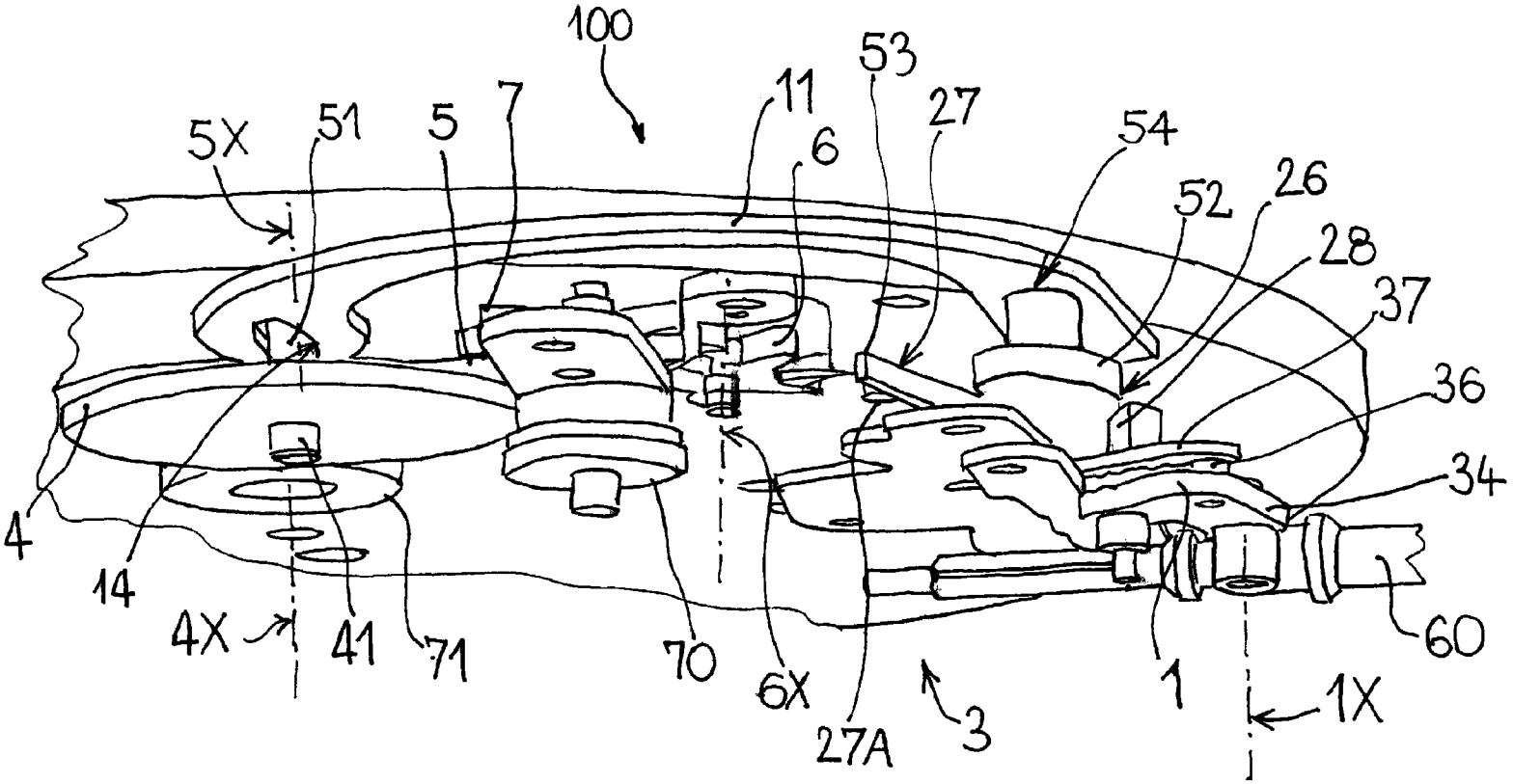
FIG. 15 shows a schematic, partial, perspective, bottom view of the mechanism of FIG. 13.

FIGS. 13 to 15 illustrate a timepiece 3 comprising a date corrector mechanism 100, in a fifth embodiment derived from the fourth embodiment. The transmission of motion to hub 51 of finger 5 occurs via a first lever 11, which comprises a second arm 47 arranged like that of the fourth embodiment illustrated by FIGS. 10 to 12, with a hole 14. This first lever 11 differs from that of the fourth embodiment, in that it does not directly include, on the first arm 46 thereof, a first edge provided with a cam 9. The uncoupling mechanism uses a control lever 52, which comprises a spring 53 tending to push said lever back towards the pull-out piece 1, and which includes, opposite said pull-out piece, an edge 19 of this type provided with a cam 20 comprising, as previously, a first path and a second path separated by a turn-back point. This control lever 52 cooperates with pull-out piece 1 and pull-out piece spring arm 37 in the same way as in the four other preceding embodiments.

The means of relative movement 9 of pivot axis 7X of corrector star-wheel 7 relative to pivot axis 5X of finger 5, is then formed by the motion transforming means 10, here more particularly formed by the control lever and pull-out piece 1 on the one hand, and by first lever 11, which is driven by the control lever at its turn-back point 48, on the other hand.

These FIGS. 13 to 15 also illustrate a variant applicable to all of the other embodiments, wherein finger 5 does not cooperate directly with corrector star-wheel 7, which cooperates with date driving star-wheel 6, but with a coaxial star-wheel 7A which pivots integrally with said corrector star-wheel 7.

FIGS. 14 and 15 show the gear train between stem 60 and corrector pinion 70, and the complete chain as far as the centre wheel.

Figure 16:
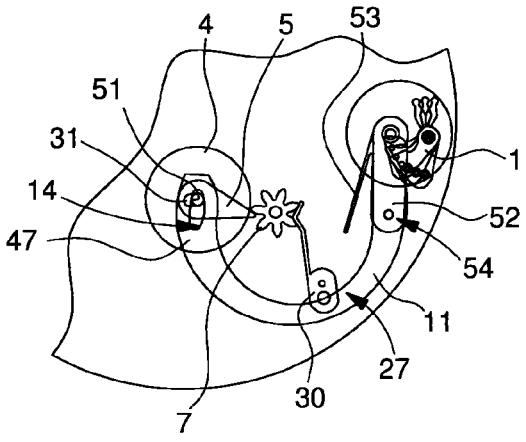
FIGS. 16 to 18 show schematic views of details of the kinematics of the fifth embodiment of FIGS. 13 and 15.
Figure 17:
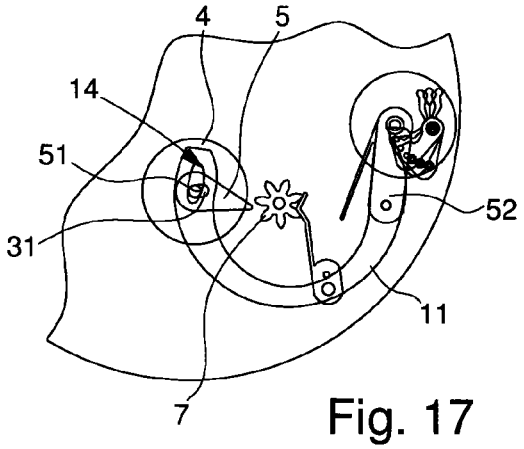
Figure 18:
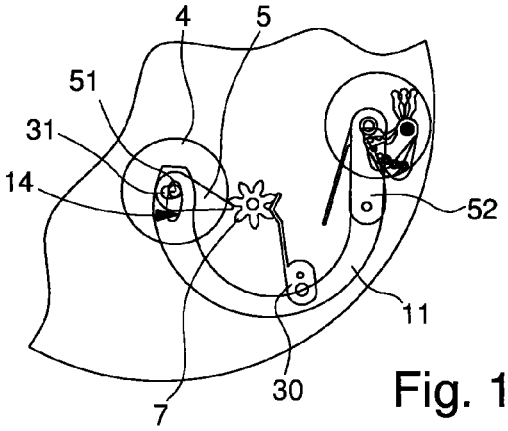

The kinematics of the fifth embodiment are shown in FIGS. 16 to 18, which show the elastic return means 27 of corrector star-wheel 7, in the form of a jumper spring 30. Lever 52 is shown with the spring 53 thereof, which cooperates with a stop member 27A seen in FIG. 15. This spring, associated with a pivot axis 54 for transmission between the first lever 11 and control lever 52, can hold or elastically return said control lever into the position shown in FIG. 16.

Figure 19:
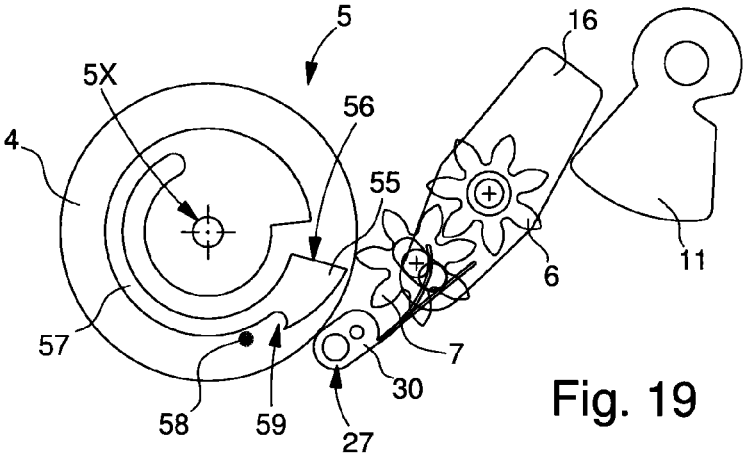
FIG. 19 shows a schematic view of a variant of the finger integral with the twenty-four hour wheel, applicable to the various embodiments.

FIG. 19 shows a variant 55 of finger 5 integral with the twenty-four hour wheel 4, which is applicable to the various embodiments above. Finger 55 is an elastic finger, preferably in the form of a circular sector. It includes a bearing surface 55 intended to cooperate with corrector star-wheel 7 and which extends at the end of a peripheral spring arm 57. This arm 57 also includes a recessed stop surface 59, which is arranged to cooperate, as an end of travel limitation, with a stop member 58 mounted on twenty-four hour wheel 4.

The advantage of this variant is that it allows, where necessary, a corrective action to be performed in the opposite direction, without damaging the mechanism: during a return movement the end of the bearing surface 55 can move aside substantially radially relative to corrector star-wheel 7, by bending spring arm 57.

With the finger 5 of the variants presented above, the mechanism is wound between said fixed finger and jumper spring 30 of corrector star-wheel 7. In this variant of finger-spring 55, the winding is progressive and balanced between this spring 57 and jumper spring 30 of corrector star-wheel 7. This arrangement allows more energy to be accumulated for a longer time.

The invention claimed is:

1. A date mechanism of a timepiece including a two-directional date corrector mechanism controlled by an actuating pull-out piece pivotally mounted about a first pivot axis, for a date mechanism of a timepiece, said date mechanism comprising:

a twenty-four hour wheel driven by a movement of said timepiece;

a date updating finger mounted to pivot integrally with said twenty-four hour wheel about a second pivot axis;

a date driving star-wheel;

a corrector star-wheel pivotally moveable about a third pivot axis and located between said finger and said date driving star-wheel, wherein said corrector star-wheel is permanently meshed with said date driving star-wheel, and wherein said corrector star-wheel is arranged to be uncoupleable from said finger under an action of an uncoupling mechanism controlled by said pull-out piece; and said uncoupling mechanism having at least two positions including at least a first coupling position in which said corrector star-wheel is arranged to mesh with said finger, and at least a second uncoupling position in which said corrector star-wheel is released from said finger to enable a date to be corrected by pivoting of said corrector star-wheel causing said date star-wheel to pivot, wherein said uncoupling mechanism includes a mechanism of relative movement of said third pivot axis of said corrector star-wheel relative to said second pivot axis of said finger, to move at least one of said second or third axes, wherein said mechanism of relative movement includes a mechanism to transform a one-directional motion applied to said actuating pull-out piece into two pivoting movements in opposite directions of a first lever pivotally mounted relative to a fourth pivot axis, said first lever including a first abutment structure arranged to directly or indirectly control the relative movement of said third pivot axis of said corrector star-wheel relative to said second pivot axis of said finger, and wherein the date mechanism includes only two layers:

an under layer including the twenty-four hour wheel and at least a part of the pull-out piece, and an upper layer including the finger, the corrector star-wheel, and the date driving star-wheel.

2. The date mechanism according to claim 1, wherein said uncoupling mechanism has three positions including the first coupling position and a third coupling position, on either side of the second uncoupling position.

3. The date mechanism according to claim 1, wherein said first abutment structure is formed by a first bearing surface of said first lever arranged to abut with a hub integral with said finger, or with a hub integral with said corrector star-wheel, to move said finger away from said corrector star-wheel or respectively to move said corrector star-wheel away from said finger.

4. The date mechanism according to claim 3, further comprising a plate comprising an oblong hole configured to receive and guide said hub integral with said finger, or said hub integral with said corrector star-wheel.

5. The date mechanism according to claim 3, wherein said first bearing surface is a first oblong hole configured to receive and guide said hub integral with said finger, or said hub integral with said corrector star-wheel.

6. The date mechanism according to claim 1, wherein said first abutment structure is configured to cooperate with a complementary abutment structure comprised in a second lever which is arranged, on a second bearing surface comprised therein, to abut with said hub integral with said finger, or with said hub integral with said corrector star-wheel, so as to move said finger away from said corrector star-wheel or respectively to move said corrector star-wheel away from said finger.

7. The date mechanism according to claim 6, wherein said second bearing surface is a second oblong hole configured to receive and guide said hub integral with said finger, or said hub integral with said corrector star-wheel.

8. The date mechanism according to claim 1, wherein said mechanism to transform a one-directional movement, applied to said actuating pull-out piece, into two opposite pivoting motions of the first lever pivotally mounted relative to the fourth pivot axis, includes at least, on a first edge of said first lever, one cam arranged to cooperate with a point of abutment of said actuating pull-out piece and extending substantially radially relative to said fourth pivot axis, said cam comprising, on a same side of a radial line derived from said fourth pivot axis and passing through a turn-back point, on either side of said turn-back point, a first path and a second path arranged to generate pivoting motions in opposite directions of said first lever during a centripetal, respectively centrifugal travel, of said point of abutment of said pull-out piece from said first path towards said second path, respectively from said second path towards said first path, passing through said turn-back point at which a reversal of direction of pivoting of said first lever occurs.

9. The date mechanism according to claim 8, wherein an elastic return mechanism is arranged to return said cam into abutment on said point of abutment of said actuating pull-out piece, and wherein said first lever is driven by a drive mechanism or by said elastic return mechanism.

10. The date mechanism according to claim 8, wherein said point of abutment of said actuating pull-out piece is formed by a first pin describing a circular rotational motion about said first pivot axis of said actuating pull-out piece.

11. The date mechanism according to claim 1, wherein said first lever is driven by a drive mechanism or by an elastic return mechanism.

12. The date mechanism according to claim 1, wherein said actuating pull-out piece is formed by a winding and time-setting pull-out piece of said timepiece.

13. The date mechanism according to claim 1, wherein said finger is formed by a finger-spring which is an elastic finger comprising a bearing surface arranged to cooperate with said corrector star-wheel, and which extends at an end of a peripheral spring arm comprised in a recessed stop surface, configured to cooperate, as an end of travel limitation, with a stop member mounted on said twenty-four hour wheel, an end of said bearing surface being moveable substantially radially relative to said corrector star-wheel, by bending said spring arm, in case of actuation in an opposite direction.

14. A timepiece comprising:

the date mechanism according to claim 1.

15. The date mechanism according to claim 1, wherein a single first lever is arranged between said pull-out piece and said finger, said first lever includes, on the same side of said fourth pivot axis, a first arm and a second arm, said first lever being held in contact against said pull-out piece by a return mechanism which tends to pivot said single first lever anti-clockwise, and wherein said second pivot axis of said twenty-four hour wheel is moveable both in a second oblong hole in a plate of the timepiece, which allows said twenty-four hour wheel to move while remaining in contact with a gear of a center wheel of the movement, which powers the twenty-four hour wheel, and in a first oblong hole which is arranged in said second arm of said single first lever, said first oblong hole extending in an oblique direction relative to the direction of said second oblong hole.

16. The date mechanism according to claim 15, wherein said fourth pivot axis is located at one end of said first lever.

17. The date mechanism according to claim 15, wherein in a first coupling position of said pull-out piece, where said pull-out piece is pushed in, said pull-out piece being held in position by the cooperation of a second pin thereof with a first notch of a pull-out piece spring arm, and wherein a first pin of said pull-out piece is abutting on a first edge located on said first arm of said single first lever on a first path, the position of said single first lever tending to pivot said single first lever, and to pull said second arm thereof, by forcing a hub of said twenty-four hour wheel to occupy a first holding position at a first end of said first oblong hole and at a first end of said oblong hole, in a position where said finger can mesh with said corrector star-wheel.

18. The date mechanism according to claim 15, wherein in a second uncoupling position of said pull-out piece, a pull-out piece arm is in an intermediate date correction position, and wherein the traction of said pull-out piece causes a second pin thereof to pass onto a second notch of a pull-out piece spring arm, a torque exerted by the latter in this position being greater than that exerted by return mechanism which pushes said single first lever back towards said pull-out piece, and a first pin of said pull-out piece remains in abutment at a turn-back point, and wherein this position of said single first lever tends to pivot said single first lever, and to push the second arm thereof, by forcing a hub of said twenty-four hour wheel to occupy a second holding position at a second end of said first oblong hole and at a second end of said second oblong hole, in a position where said finger is disengaged from said corrector star-wheel.

19. The date mechanism according to claim 15, wherein in a third coupling position of said pull-out piece, which is the position of maximum traction of a crown connected to said pull-out piece, which is held by the abutment of a second pin thereof in a third notch of a pull-out piece spring arm, wherein the traction of said pull-out piece brings a first pin thereof into the groove of a second path, this movement allowing a rotation of said single first lever in the opposite direction, which returns said second arm thereof into traction, forcing a hub of said twenty-four hour wheel to occupy a first holding position at a first end of the first oblong hole and at a first end of the second oblong hole, in a position where said finger can mesh with said corrector star-wheel.

20. A date mechanism of a timepiece including a two-directional date corrector mechanism controlled by an actuating pull-out piece pivotally mounted about a first pivot axis, for a date mechanism of a timepiece, said date mechanism comprising:

a twenty-four hour wheel driven by a movement of said timepiece;

a date updating finger mounted to pivot integrally with said twenty-four hour wheel about a second pivot axis;

a date driving star-wheel; and said corrector mechanism comprising a corrector star-wheel distinct from said date driving star-wheel, said corrector star-wheel pivotally moveable about a third pivot axis distinct from said second pivot axis and located between said finger and said date driving star-wheel, wherein said corrector star-wheel is permanently meshed with said date driving star-wheel, a daily motion of said finger to update a date being only transmitted to said date driving star-wheel via said corrector star-wheel, and wherein said corrector star-wheel is arranged to be uncoupleable from said finger under an action of an uncoupling mechanism controlled by said pull-out piece, said uncoupling mechanism having at least two positions including at least a first coupling position in which said corrector star-wheel is arranged to mesh with said finger, and at least a second uncoupling position in which said corrector star-wheel is released from said finger to enable the date to be corrected by pivoting of said corrector star-wheel causing said date star-wheel to pivot, and wherein said second pivot axis of said finger is fixed, whereas said third pivot axis of said corrector star-wheel is moveable, and wherein said uncoupling mechanism includes a mechanism of relative movement of said third pivot axis of said corrector star-wheel relative to said second pivot axis of said finger, to move said third pivot axis.

21. A date mechanism of a timepiece including a two-directional date corrector mechanism controlled by an actuating pull-out piece pivotally mounted about a first pivot axis, for a date mechanism of a timepiece, said date mechanism comprising:

a twenty-four hour wheel driven by a movement of said timepiece;

a date updating finger mounted to pivot integrally with said twenty-four hour wheel about a second pivot axis;

a date driving star-wheel;

a corrector star-wheel pivotally moveable about a third pivot axis and located between said finger and said date driving star-wheel, wherein said corrector star-wheel is permanently meshed with said date driving star-wheel, and wherein said corrector star-wheel is arranged to be uncoupleable from said finger under an action of an uncoupling mechanism controlled by said pull-out piece; and said uncoupling mechanism having at least two positions including at least a first coupling position in which said corrector star-wheel is arranged to mesh with said finger, and at least a second uncoupling position in which said corrector star-wheel is released from said finger to enable a date to be corrected by pivoting of said corrector star-wheel causing said date star-wheel to pivot, and wherein the date mechanism includes only two layers:

an under layer including the twenty-four hour wheel and at least a part of the pull-out piece, and an upper layer including the finger, the corrector star-wheel, and the date driving star-wheel.

* * * * *